US006477992B2

(12) United States Patent
Hartke et al.

(10) Patent No.: US 6,477,992 B2
(45) Date of Patent: Nov. 12, 2002

(54) OILING SYSTEM

(75) Inventors: David J. Hartke, Gurnee, IL (US); Richard P. Kolb, Prairieview, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 10/002,380

(22) Filed: Oct. 20, 2001

(65) Prior Publication Data

US 2002/0040695 A1 Apr. 11, 2002

Related U.S. Application Data

(63) Continuation of application No. 09/432,533, filed on Nov. 3, 1999, now Pat. No. 6,390,033.

(51) Int. Cl.[7] ..... F02B 33/04

(52) U.S. Cl. ..... 123/73 AD; 123/196 R; 123/196 W; 440/88

(58) Field of Search ..... 123/73 AD, 196 R, 123/196 S, 196 W; 440/88

(56) References Cited

U.S. PATENT DOCUMENTS

| | | | | |
|---|---|---|---|---|
| 4,142,486 A | | 3/1979 | Schreier | 123/73 AD |
| 4,372,258 A | | 2/1983 | Iwai | 123/73 AD |
| 4,403,578 A | | 9/1983 | Iwai et al. | 123/73 AD |
| 4,414,929 A | | 11/1983 | Sakurai | 123/73 R |
| 4,452,195 A | | 6/1984 | Matsumoto et al. | 123/195 AC |
| 4,471,727 A | | 9/1984 | Odashima | 123/73 AD |
| 4,632,085 A | * | 12/1986 | Misawa et al. | 123/73 AD |
| 4,637,355 A | | 1/1987 | Odashima | 123/73 AD |
| 4,638,771 A | * | 1/1987 | Mori | 123/73 AD |
| 5,460,555 A | | 10/1995 | Fukuoka et al. | 440/88 |
| 5,630,383 A | * | 5/1997 | Kidera et al. | 123/196 R |
| 5,632,241 A | * | 5/1997 | Binversie et al. | 123/196 W |
| 5,713,325 A | | 2/1998 | Yoshida et al. | 123/295 |
| 5,787,847 A | | 8/1998 | Ozawa et al. | 123/73 AD |
| 5,806,473 A | | 9/1998 | Kometani et al. | 123/73 C |
| 5,829,401 A | * | 11/1998 | Masuda | 123/196 R |
| 5,941,745 A | | 8/1999 | Kanno | 440/88 |

* cited by examiner

*Primary Examiner*—Noah P. Kamen
(74) *Attorney, Agent, or Firm*—Timothy J. Ziolkowski; J. Mark Wilkinson

(57) ABSTRACT

The present invention, in one form, is an oiling system for an outboard engine and includes an oil tank and an oil pump located within the tank. A manifold is coupled to the oil pump, and the manifold includes a solenoid controlled valve. The solenoid controlled valve controls the flow of oil through the manifold. The manifold further includes a plurality of check valves in flow communication with the solenoid controlled valve. The check valves are in flow communication between the solenoid controlled valve and the engine cylinders. The oil system, in the one embodiment, further includes a pressure regulator in flow communication with, and downstream from, the manifold. An outlet of the pressure regulator in flow communication with the oil tank, and allows oil to flow from the manifold to the tank when pressure in the system exceeds a preselected pressure. The oil system also includes a fuel solenoid controlled valve coupled to receive oil from the manifold and to supply oil to the engine fuel system. The engine includes an electronic control unit (ECU) for controlling the manifold solenoid and the fuel solenoid. In one embodiment, the ECU controls opening of the manifold solenoid valve and the fuel solenoid valve based on engine revolutions per minute.

21 Claims, 3 Drawing Sheets

OILING SYSTEM

CROSS-REFERENCE TO RELATED APPLICATION

The present application is a continuation and claims priority of allowed U.S. patent application Ser. No. 09/432,533 to Hartke et al., filed on Nov. 3, 1999, entitled "Oiling System", now U.S. Pat. No. 6,390,033.

BACKGROUND OF THE INVENTION

This invention relates generally to supplying oil to cylinders of internal combustion engines, and more particularly, to passive flow oiling systems for such engines.

Known engines for marine use typically include an oil lift pump which draws oil out from an oil tank, and then pumps the oil to a manifold for distribution to engine cylinders. Such pumps must be highly reliable in order to maintain adequate lubrication in the engine cylinders, and typically are expensive. In addition, and if the oil in the oil tank has thickened, e.g., due to cold whether, the oil lift pump may not draw sufficient quantities of oil from the tank during a cold start to adequately lubricate the cylinder walls, which can potentially lead to damaging the cylinders.

BRIEF SUMMARY OF THE INVENTION

The present invention, in one aspect, is an oiling system for an outboard engine and includes an oil tank and an oil pump located within the tank. A manifold is coupled to the oil pump, and the manifold includes a solenoid controlled valve. The solenoid controlled valve controls the flow of oil through the manifold. The manifold further includes a plurality of check valves in flow communication with the solenoid controlled valve. The check valves are in flow communication between the solenoid controlled valve and the engine cylinders.

The oil system, in the one embodiment, further includes a pressure regulator in flow communication with, and downstream from, the manifold. An outlet of the pressure regulator in flow communication with the oil tank, and allows oil to flow from the manifold to the tank when pressure in the system exceeds a preselected pressure. The oil system also includes a fuel solenoid controlled valve coupled to receive oil from the manifold and to supply oil to the engine fuel system.

The engine includes an electronic control unit (ECU) for controlling the manifold solenoid and the fuel solenoid. In one embodiment, the ECU controls opening of the manifold solenoid valve and the fuel solenoid valve based on engine revolutions per minute.

The above described oiling system provides the advantage that the oil pump is located within the oil tank. Therefore, rather than relying upon drawing oil out of the oil tank, the above described system pumps oil from the tank. Even if the oil in the tank has thickened due to cold weather, for example, the heat generated by the pump heats the oil and causes the oil to thin out so that it can be more easily pumped through the oil supply line to the fuel system. In addition, the manifold solenoid controlled valve provides a positive control for the flow of oil to the engine cylinders, and such control reduces the likelihood of air bubbles forming in the oil line. Preventing air bubbles from forming in the oil line is important to ensure sufficient oil is provided to the engine cylinders.

DETAILED DESCRIPTION OF THE INVENTION

Although the present invention is sometimes described herein in the context of an outboard engine for marine use, the invention can be used in many other applications and is not limited to use in connection only with marine engines.

Figure 1:
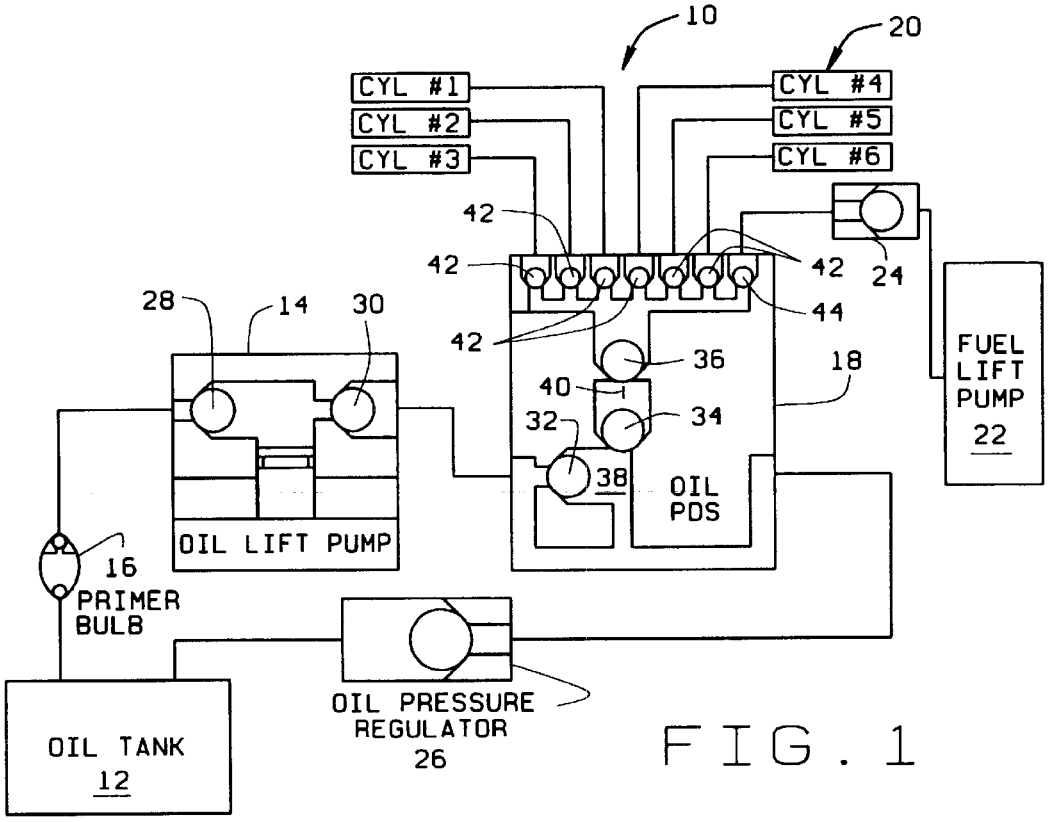
FIG. 1 is a schematic illustration of a known lift pump type oiling system.

Referring now specifically to the drawings, FIG. 1 is a schematic illustration of a known lift pump type oiling system 10. System 10 includes an oil tank 12 coupled to an oil lift pump 14. A primer bulb 16 is located in the flow path between tank 12 and pump 14 to enable manual priming of system 10. Pump 14 is coupled to an oil manifold 18. Manifold 18 is coupled to supply oil to cylinders #1–#6 of an engine 20, and also is coupled to supply oil to a fuel lift pump 22. A check valve 24 is in flow communication between fuel lift pump 22 and manifold 18 to prevent flow of fuel from fuel pump 22 to manifold 18. Manifold 18 also is in flow communication with oil tank 12 via an oil pressure regulator 26, which prevents back flow of oil from tank 12 directly to manifold 18.

Oil lift pump 14 includes an inlet check valve 28 and an outlet check valve 30. Pump 14 draws oil from oil tank 12 and through inlet check valve 28. When sufficient pressure is built-up within pump 14, the oil is forced through outlet check valve 30 and flows to manifold 18.

Manifold 18 includes an inlet check valve 32, a first stage check valve 34 and a second stage check valve 36. Oil under pressure from pump 14 flows into manifold 18 through inlet check valve 32. First stage check valve 34 opens when the oil pressure in first chamber 38 is in a range between about 9–12 psi. Second stage check valve 36 opens when the oil pressure in second chamber 40 is in a range between about 41–45 psi. Separate cylinder check valves 42 are provided so that oil flows from second chamber 40 to respective cylinders #1–#6, and prevent the back flow of oil from the cylinders into manifold 18. In addition, a fuel lift pump check valve 44 is provided to prevent the back flow of oil from check valve 24 into manifold 18.

In operation, oil lift pump 14 draws oil out from oil tank 12, and then pumps the oil to manifold 18 for distribution to the engine cylinders. If the oil in oil tank 12 has thickened, e.g., due to cold whether, oil lift pump 14 may not draw sufficient quantities of oil from tank 12 during a cold start to adequately lubricate the cylinder walls, which can potentially lead to damaging the cylinders.

Figure 2:
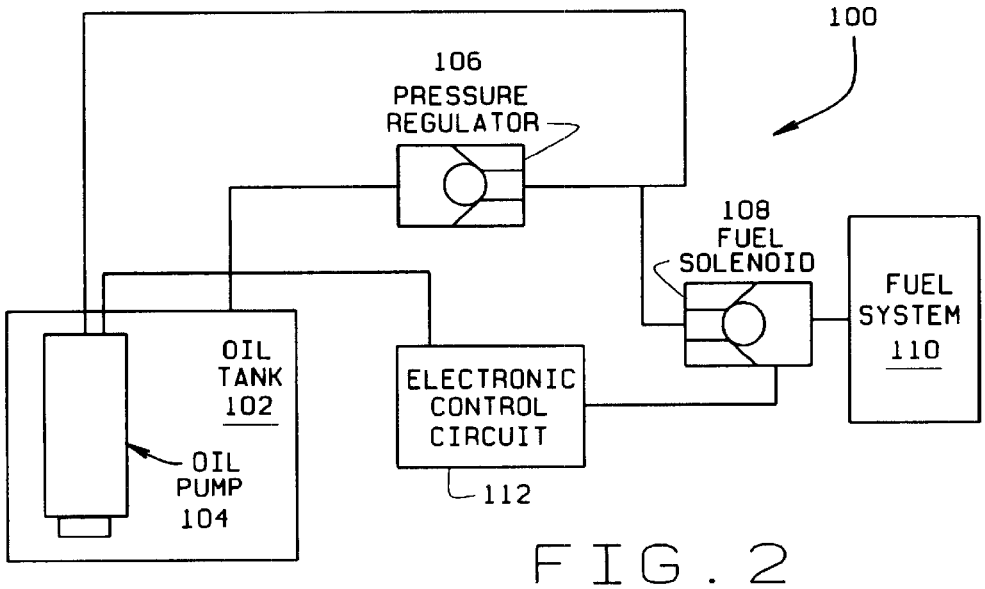
FIG. 2 is a schematic illustration of an oiling system in accordance with one embodiment of the present invention.

FIG. 2 is a schematic illustration of an oiling system 100 in accordance with one embodiment of the present invention. System 100 is configured for use in connection with a carbureted engine, and includes an oil tank 102 having an oil pump 104 located therein. Pump 104 is coupled to an inlet of a pressure regulator 106, illustrated as a check valve. An output of regulator 106 is coupled to tank 102. Pump 102 also is coupled to an inlet of a fuel solenoid 108, and an outlet of fuel solenoid 108 is coupled to a fuel system 110 for the engine.

A controller, illustrated as an electronic control circuit 112, is provided for controlling operation of oil pump 104 and fuel solenoid 108. Circuit 112, in one embodiment, includes a microprocessor programmed to control the supply of oil from tank 102 to fuel system 110 based on the operation of the engine. In an exemplary embodiment, the microprocessor controls the delivery of oil to fuel system 110 based on engine revolutions per minute, i.e., an RPM based control.

In operation, and when circuit 112 energizes pump 104, pump 104 pumps oil to pressure regulator 106 which remains closed until the pressure in the oil line exceeds a predetermined threshold pressure. Oil also is supplied. to fuel solenoid 108 which remains closed until circuit 112 controls the solenoid to open the solenoid controlled valve. If solenoid 108 remains closed and sufficient pressure builds-up, regulator 106 opens and the oil flows back into tank 102. If solenoid 108 opens, then oil flows to fuel system 110.

Oiling system 100 provides the advantage that oil pump 104 is located within oil tank 102. Therefore, even if the oil in tank 102 has thickened due to cold weather, the heat generated by pump 104 will heat the oil and cause the oil to thin out so that it can be more easily pumped through the oil supply line to fuel system 110.

Figure 3:
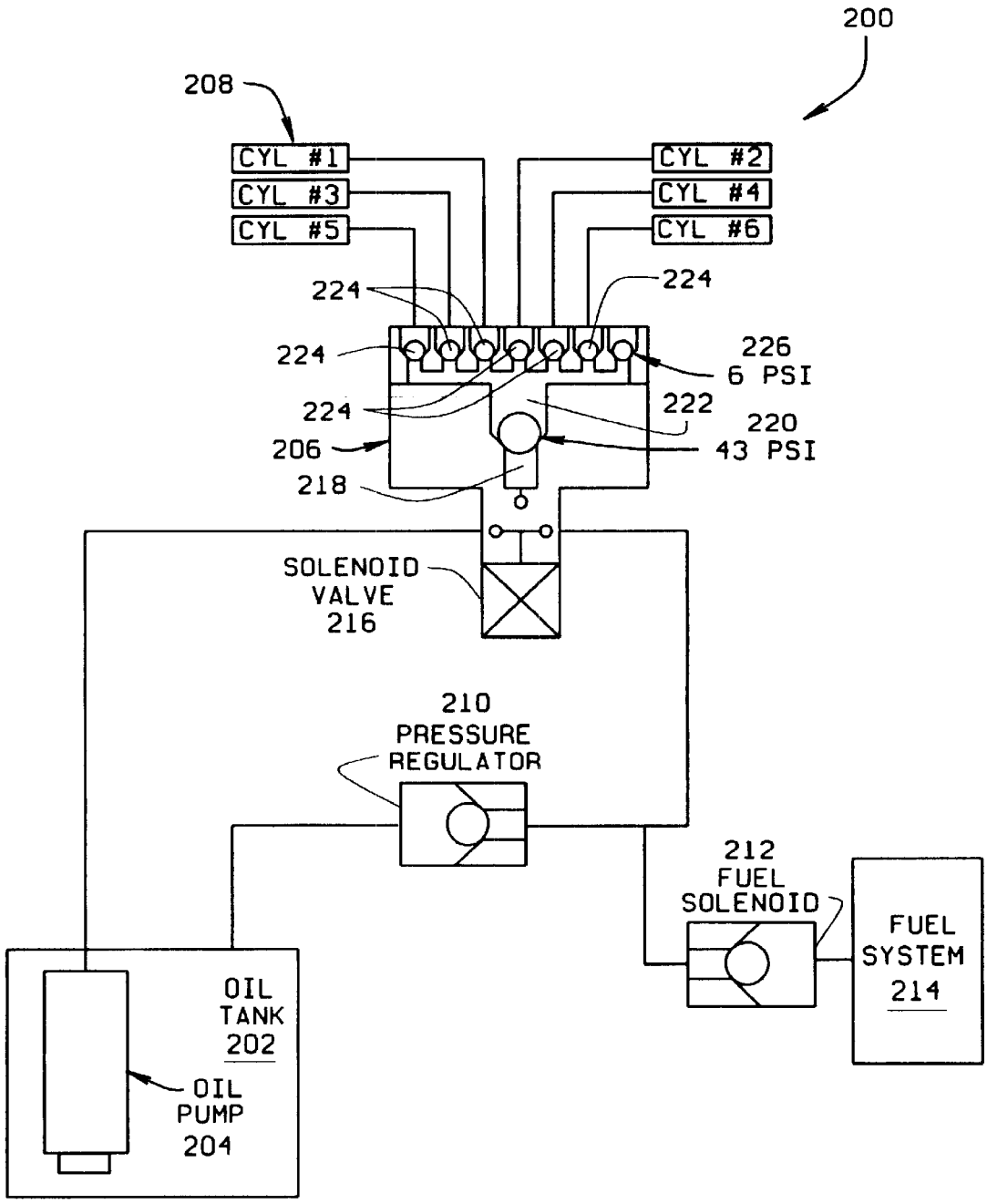
FIG. 3 is a schematic illustration of an oiling system in accordance with another embodiment of the present invention.

FIG. 3 is a schematic illustration of an oiling system 200 in accordance with another embodiment of the present invention. System 200 is configured for use in connection with a fuel injected engine, and includes an oil tank 202 having an oil pump 204 located therein. Pump 204 is coupled to an inlet of a manifold 206, and outlets of manifold 206 are coupled to coupled to supply oil to cylinders #1–#6 of an engine 208. Manifold 206 also is in flow communication with oil tank 202 via an oil pressure regulator 210, which prevents back flow of oil from tank 202 directly to manifold 206. Manifold 206 also is coupled to an inlet of a fuel solenoid 212, and an outlet of fuel solenoid 212 is coupled to a fuel system 214 for the engine.

Manifold 206 includes a solenoid controlled inlet valve 216 which controls opening and closing of the manifold inlet and outlet. Manifold 206 further includes a first chamber 218 that oil flows into, arid a check valve 220 intermediate first chamber 218 and a second chamber 222. First check valve 220 opens when the pressure of oil in first chamber 218 exceeds 43 psi. Separate cylinder check valves 224 are provided so that oil flows from second chamber 222 to respective cylinders #1–#6, and prevent the back flow of oil from the cylinders into manifold 206. In addition, a fuel lift pump check valve 226 is provided to prevent the back flow of oil from check valve 226 into manifold 206.

Operation of oil pump 204, solenoid valve 216, and fuel solenoid 212 is controlled by an electronic control unit (ECU) of engine 208. As is known in the art, ECU includes a processor programmed to control numerous operations of engine 208. When the engine ignition key is turned, ECU energizes pump 204 so that oil is under pressure even before combustion is initiated. Once engine 208 is started, the ECU controls solenoid valve 216 to control the supply of oil to the cylinders. A pressure sensor may be located in second chamber 222 of manifold 206 in the event that the pressure in second chamber 222 falls below a selected pressure, an alarm warning is displayed to the operator. In the event that ECU determines that more oil should be supplied to the cylinders, ECU energizes control solenoid valve 216 allowing oil to be pumped into first chamber 218 of manifold 206. When not energized by the ECU, control solenoid valve 216 allows oil to recirculate through pressure regulator 210 and into oil tank 202.

As with oiling system 100, oiling system 200 provides the advantage that the oil pump is located within the oil tank. Therefore, rather than relying upon drawing oil out of the oil tank, system 200 pumps oil from the tank. Even if the oil in the tank has thickened due to cold weather, for example, the heat generated by the pump heats the oil and causes the oil to thin out so that it can be more easily pumped through the oil supply line to the fuel system.

Many variations of the above described embodiment are possible. For example, rather than having a single check valve 220, two check valves (e.g., such as check valves 34 and 36 in FIG. 1) could be utilized in manifold 206.

Figure 4:
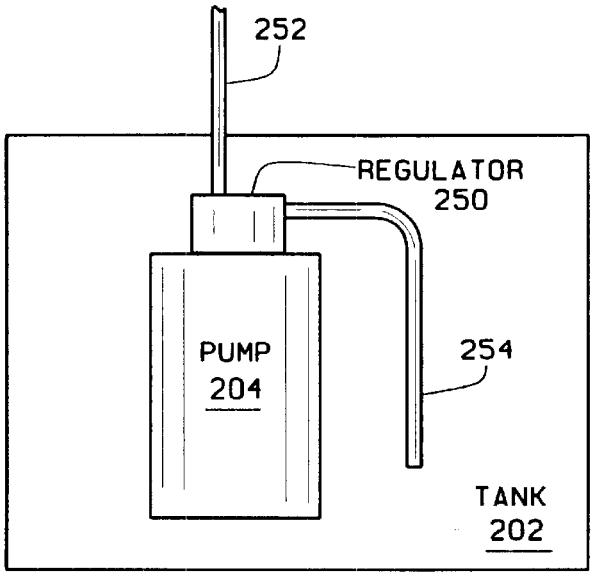
FIG. 4 illustrates a portion of an oiling system.

In addition, and referring to FIG. 4 which is illustrates a portion of tank 202, pump 204 could include a pressure regulator 250 coupled to an outlet tube 252 which extends from pump 205 to manifold 206 (not shown in FIG. 4). Regulator 250 provides that in the event that pressure within tube 252 exceeds a predetermined pressure, then oil flows directly from pump 204 through an outlet tube 254 and mixes back with the oil in tank 202. With this type of configuration, pressure regulator 210 (FIG. 3) can be eliminated, and the outlet of manifold 206 is coupled only to fuel solenoid controlled valve 212.

Figure 5:
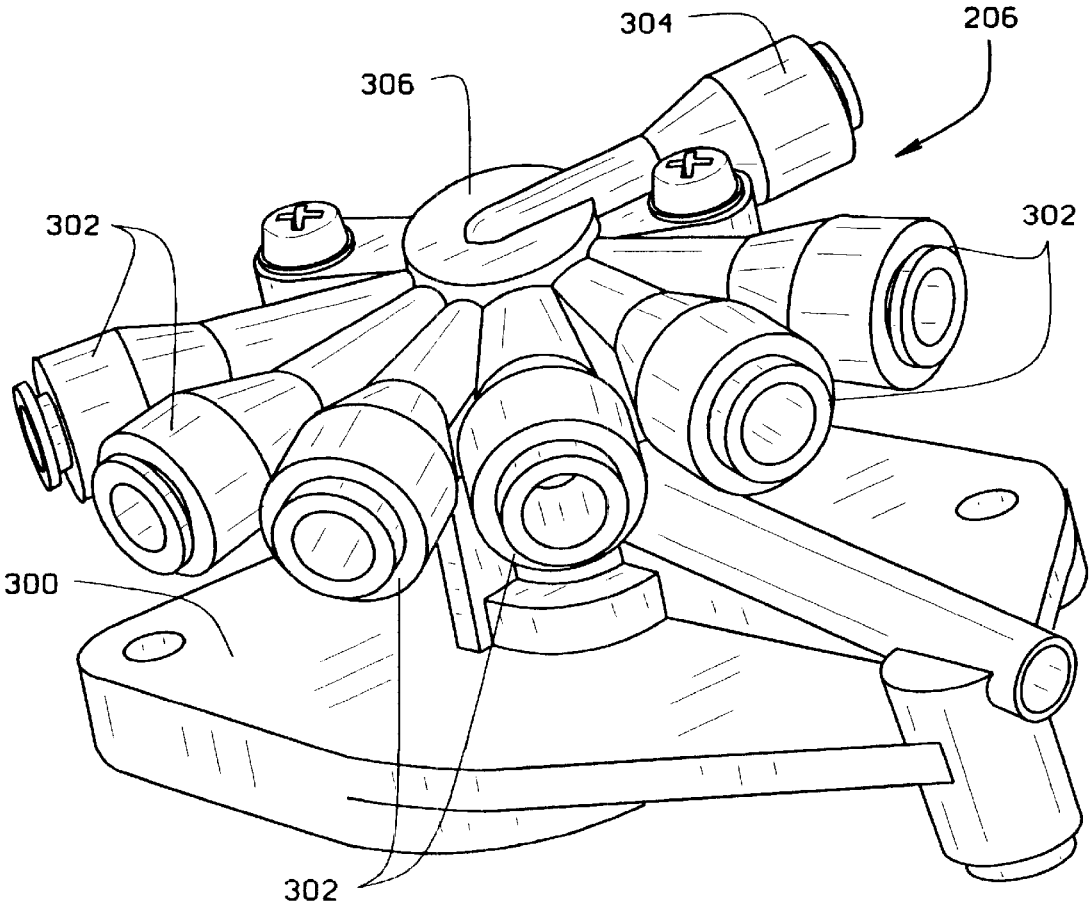
FIG. 5 is a perspective view of a manifold for a six cylinder engine.

FIG. 5 is a perspective view of a portion of manifold 206 for six cylinder engine 208. Manifold 206 includes a base 300 for mounting to the solenoid controlled valve. Manifold 206 also includes six nozzles 302 for being coupled to oil lines that extend from each respective nozzle 302 to one of the engine cylinders. In addition, a fuel lift pump nozzle 304 is provided for coupling to an oil line that extends to the fuel lift pump via a check valve. Check valves are located in each nozzle 302 and 304. A central oil flow chamber 306 is in flow communication with each nozzle 302 and 304 so that oil can flow from the second chamber of the valve and through each nozzle 302 and 304.

Many variations of manifold 206 are possible. For example, for an eight cylinder engine, nine nozzles would be provided, i.e., one nozzle for each cylinder and one nozzle for the fuel system. Further, it is not necessary to provide a nozzle for the fuel system, and that nozzle can be eliminated.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An oiling system comprising:

an oil tank having an inlet and an outlet and an oil pump therein;

an oil flow communication system connecting the outlet of the oil tank to the inlet of the oil tank and to a fuel system of an engine to supply oil thereto; and a solenoid valve connected to the oil flow communication system to control oil flow from the oil pump within the oil tank to each cylinder of the engine and to the oil tank without a pump external to the oil tank.

2. The oiling system of claim 1 wherein the solenoid valve is connected to supply oil to the engine through a fuel system alternately with returning oil to the oil tank.

3. The oiling system of claim 1 wherein the solenoid is connected to supply oil to the engine through a distribution manifold and periodically returning oil to the oil tank.

4. The oiling system of claim 3 wherein the distribution manifold has at least one outlet for each cylinder of an engine, and wherein each outlet has a check valve therein.

5. The oiling system of claim 4 wherein the distribution manifold has at least one additional outlet in communication with a fuel lift pump.

6. The oiling system of claim 3 further comprising a second solenoid valve connecting the oil flow communication system to a fuel system of the engine.

7. The oiling system of claim 3 further comprising a pressure regulator in flow communication with, and downstream from, the distribution manifold, an outlet of the pressure regulator in flow communication with the oil tank.

8. The oiling system of claim 1 further comprising a controller to control opening of the solenoid valve based on engine revolutions per minute.

9. The oiling system of claim 1 further comprising a pressure regulator coupled to an outlet of the oil pump, and an oil return tube connected to an outlet of the pressure regulator.

10. The oiling system of claim 9 wherein the pressure regulator is located within the oil tank.

11. The oiling system of claim 1 wherein the engine is an outboard motor and the oil tank is located in a boat remote from the outboard motor.

12. A kit for an outboard marine engine comprising:

an oil tank having an oil pump therein, the oil tank having supply and return ports connectable to oil supply and return lines;

a regulator connectable to the oil return line;

a solenoid connectable to the oil supply line; and a control unit connectable to the solenoid to control a flow of oil to an engine when open and return oil to the oil tank when closed without a separate primer bulb.

13. The kit of claim 12 further comprising a manifold configured to be coupled to the oil pump, the manifold comprising a solenoid controlled inlet valve arranged to control the flow of oil through the manifold.

14. The kit of claim 12 further comprising a fuel solenoid controlled valve configured to be coupled to receive oil pumped by the oil pump and supply the oil to a fuel system.

15. The kit of claim 14 further comprising a controller for controlling opening of the fuel valve.

16. The kit of claim 14 wherein the oil tank is configured for placement in a boat hull remote from the outboard marine engine.

17. An electronic control unit having a processor programmed to:

energize an oil pump;

actuate a solenoid valve to control a supply of oil to a plurality of engine cylinders when the solenoid valve is open;

determine if oil is needed to the plurality of engine cylinders; and if so, actuate the solenoid valve to allow oil to be pumped from the oil pump to the plurality of engine cylinders; and disable the solenoid valve to return oil to the oil tank when it is determined that oil is not needed while the solenoid valve is closed.

18. The electronic control unit of claim 17 wherein the processor is further programmed to allow the solenoid value to re-circulate oil through a pressure regulator and into the oil tank if sufficient oil is being applied to the engine cylinders.

19. A method of oiling an internal combustion engine, the method comprising:

energizing an oil pump disposed interiorly of an oil tank;

supplying oil from the oil tank to a plurality of cylinders of an internal combustion engine;

determining if oil is needed to the plurality of cylinders; and if not, returning the unneeded oil to the oil tank.

20. The method of claim 19 further comprising determining a fall in pressure of the oil being supplied to the plurality of cylinders.

21. The method of claim 19 further comprising pressurizing oil prior to starting of the internal combustion engine.

* * * * *

UNITED STATES PATENT AND TRADEMARK OFFICE

CERTIFICATE OF CORRECTION

PATENT NO. : 6,477,992 B2
DATED : November 12, 2002
INVENTOR(S) : Hartke et al.

It is certified that error appears in the above-identified patent and that said Letters Patent is hereby corrected as shown below:

Column 3,
Line 41, delete the word "arid" and substitute therefore -- and --.

Signed and Sealed this

Fourth Day of March, 2003

JAMES E. ROGAN
*Director of the United States Patent and Trademark Office*